United States Patent [19]

Rutz et al.

[11] 4,056,042

[45] Nov. 1, 1977

[54] ROTARY HYDROSTATIC PISTON MACHINE WITH ECCENTRICALLY MOVABLE GUIDE MEANS

[75] Inventors: Peter Rutz, Winterthur; Anton Steiger, Illnau, both of Switzerland

[73] Assignee: Sulzer Brothers Limited, Winterthur, Switzerland

[21] Appl. No.: 668,970

[22] Filed: Mar. 22, 1976

[30] Foreign Application Priority Data

Apr. 2, 1975 Switzerland ..... 4143/75

[51] Int. Cl.[2] ..... F01B 1/06; F01B 13/06

[52] U.S. Cl. ..... 91/497

[58] Field of Search ..... 91/491, 497; 92/12.1; 417/221

[56] References Cited

U.S. PATENT DOCUMENTS

| | | | |
|---|---|---|---|
| 2,431,071 | 11/1947 | Norman | 92/12.1 |
| 3,708,250 | 1/1973 | Thumm | 417/221 |
| 3,747,477 | 7/1973 | Aldinger | 91/497 |
| 3,750,533 | 8/1973 | Thoma | 91/498 |
| 3,785,250 | 1/1974 | Steiger | 91/491 |

FOREIGN PATENT DOCUMENTS

| | | | |
|---|---|---|---|
| 413,377 | 4/1946 | Italy | 91/497 |

*Primary Examiner*—John J. Vrablik

*Attorney, Agent, or Firm*—Kenyon & Kenyon, Reilly, Carr & Chapin

[57] ABSTRACT

The hydrostatic piston machine has a smooth cylindrical pintle which is fixedly mounted in the housing and on which a cylinder block is rotatably mounted. The guide member for the pistons is eccentrically mounted about the pintle and has means thereon for supplying and/or taking off the torque of the machine. The eccentricity of this guide member is adjusted by a movable guide means within the housing. This guide means is controlled by the pressure mdium flowing through the machine.

7 Claims, 5 Drawing Figures

Figure 1:
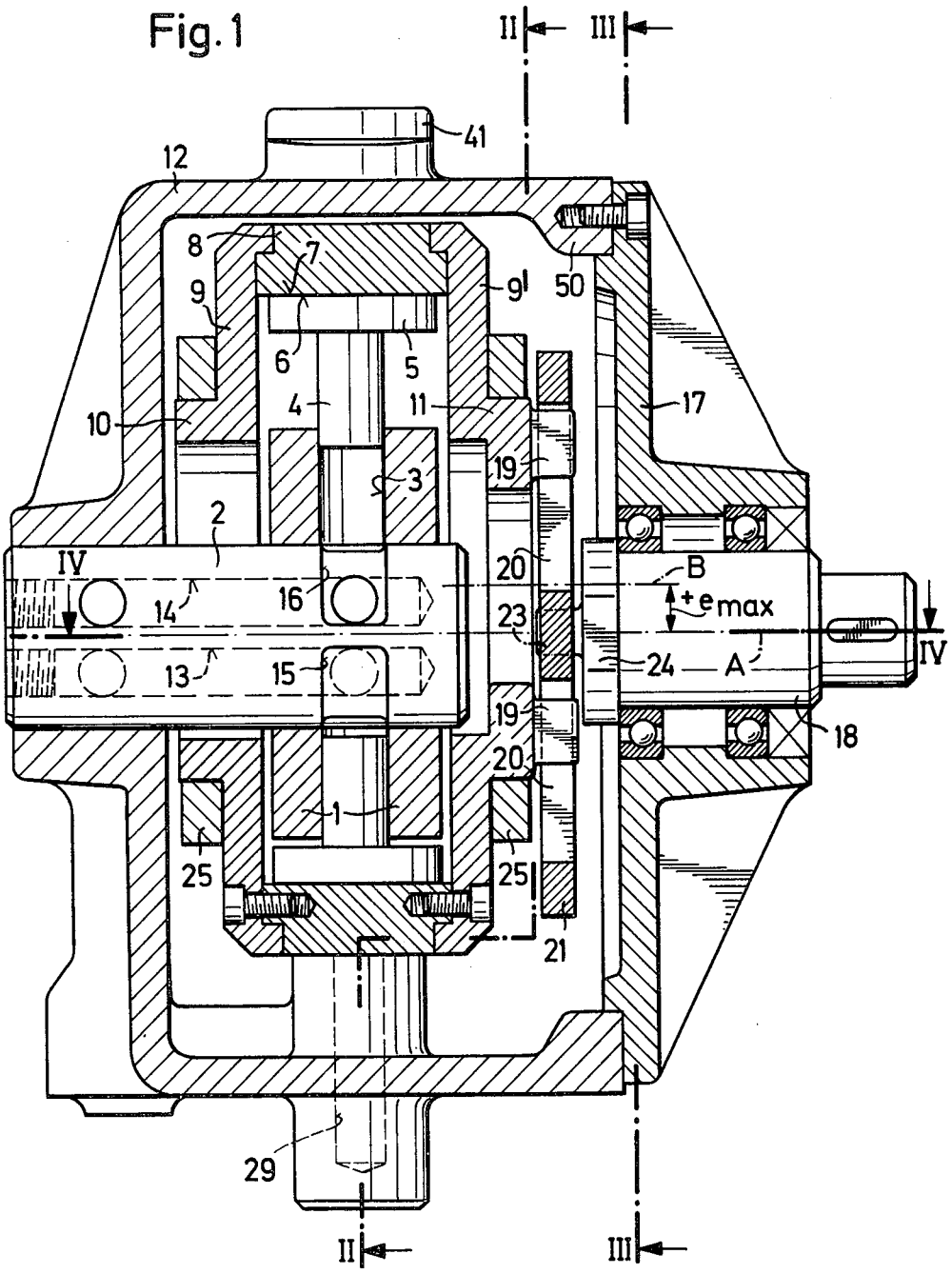

47
36
44
40
43
41
45
46
I
12
39
42
32
37
38
25
35
38
19
27
16
-1-
2
B
15
14
+emax
A
C
-emax
13
26'
-11-
14
19
28
-9'-
30
29
I
48
49

ROTARY HYDROSTATIC PISTON MACHINE WITH ECCENTRICALLY MOVABLE GUIDE MEANS

This invention relates to a hydrostatic piston machine.

As is known, hydrostatic piston machines generally have a cylinder block which is rotatable about a pintle as well as pistons which are distributed along the periphery of the cylinder block to be guided radially with respect to the pintle. The outer ends of these pistons usually have plane support surfaces which are guided along plane guide surfaces of a guide member which are disposed tangentially to a circular cylindrical surface normally eccentric to the axis of the cylinder block, one end of the pintle being fixed in a housing. In machines of this kind, the pintles have usually had an eccentric portion. However, the eccentricity of this portion cannot be varied. Thus, if it be necessary to vary the eccentricity of the machine, for example in order to vary the delivery volume of a machine operating as a pump, or reverse the delivered flow, the pintle has required mounting in an element which is slidable in relation to the housing and to the guide member and which can then be adjusted according to the required variation in eccentricity. Such machines, are however, complicated in their construction.

Accordingly, it is an object of the invention to provide a hydrostatic piston machine in which the eccentricity is adjustable with simple means using a smooth pintle which is fixed at one end in the housing.

It is another object of the invention to provide a hydrostatic piston machine of simple construction.

It is another ojbect of the invention to provide a hydrostatic piston machine of variable eccentricity which can be assembled in a relatively easy and rapid manner.

Briefly, the invention provides a hydrostatic piston machine which comprises a housing, a pintle which is fixedly secured within the housing about a longitudinal axis, a guide member concentrically about the pintle on a second axis to guide pistons thereon and a movable quide means within the housing which mounts the guide member therein in order to move the guide member axis relative to the pintle axis and, thus, to establish an eccentricity therebetween.

The guide member if formed with a plurality of plane guide surfaces disposed tangentially to a circular surface in order to guide pistons thereon. Such pistons are movably mounted in a cylinder block which is rotatably mounted on the pintle within the housing. The pistons are arranged peripherally of the cylinder block and each has a support surface at an outer end.

The movable guide means mounts the guide member therein at opposite sides of the guide member.

In addition, means are provided on the guide member for supplying and/or taking-off the torque of the machine.

Even in the case of variable-eccentricity machines, the invention allows the use of a smooth pintle (i.e. one without an eccentric portion) fixed in the housing, so that the machine construction and hence assembly are greatly simplified. This is because the cylinder block containing the pistons, the guide member and the guide means can be assembled as a structural unit.

According to one embodiment of the invention, the guide member comprises two central outwardly extending hub-like projections by means of which the member is mounted in corresponding bores of the guide means. The advantage of this is that the guide member has the maximum stiffness, because the diameter of the bore which surrounds the pintle and weakens the guide element is reduced to a minimum, i.e. substantially equal to the pintle diameter plus twice the maximum eccentricity.

In another advantageous embodiment of the invention, the guide means utilizes a pair of one-armed pivoting levers within the housing. The housing dimensions can thus be kept very small. In this embodiment, the pivot axis of the pair of pivoting levers is disposed within or on the circumference of the guide member. The advantage of this is that the configuration of the housing can be closely matched to the space required for the movable parts because no small indentations are required in the housing to mount the pivoting lever.

Figure 2:
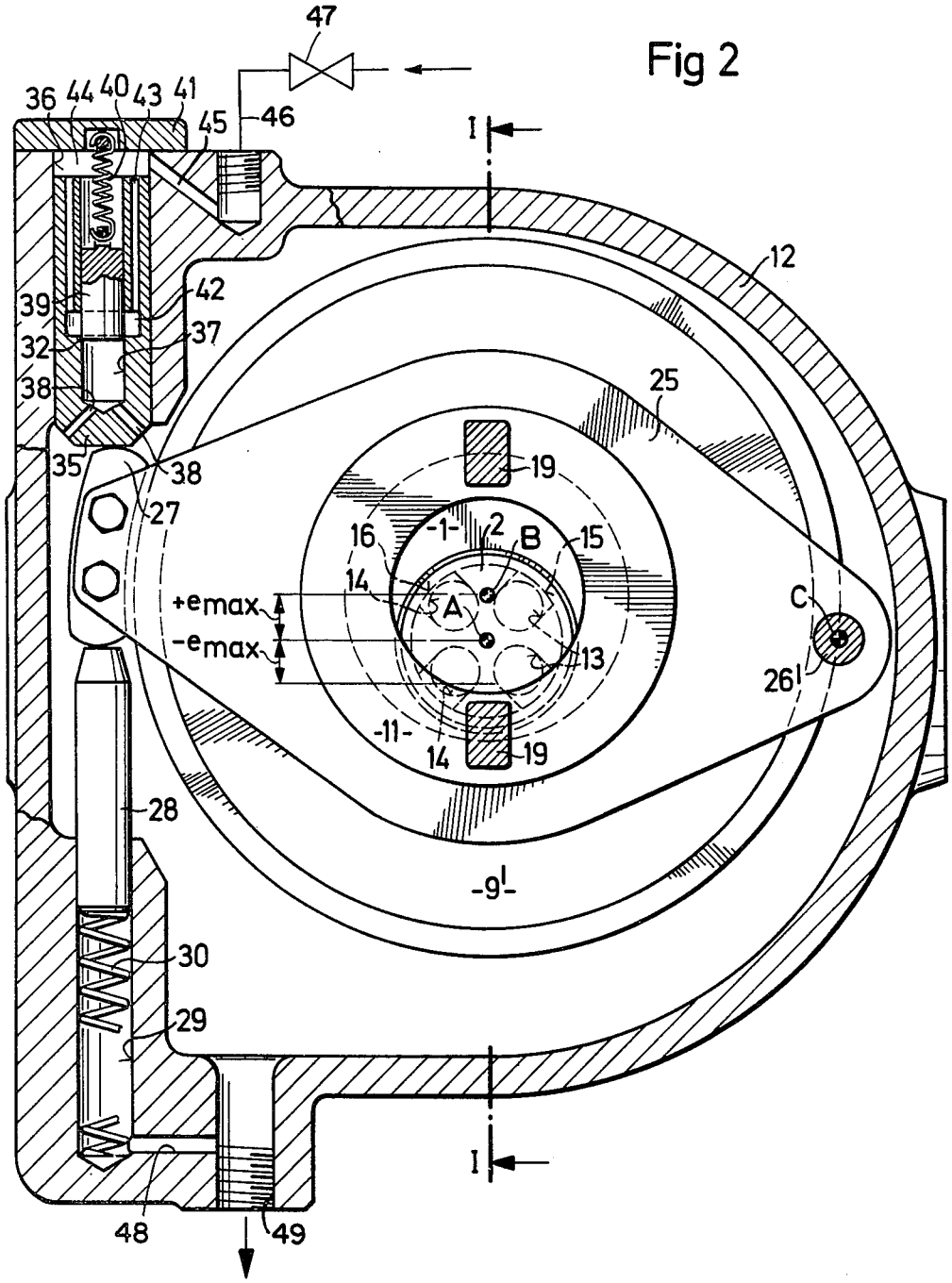
Figure 3:
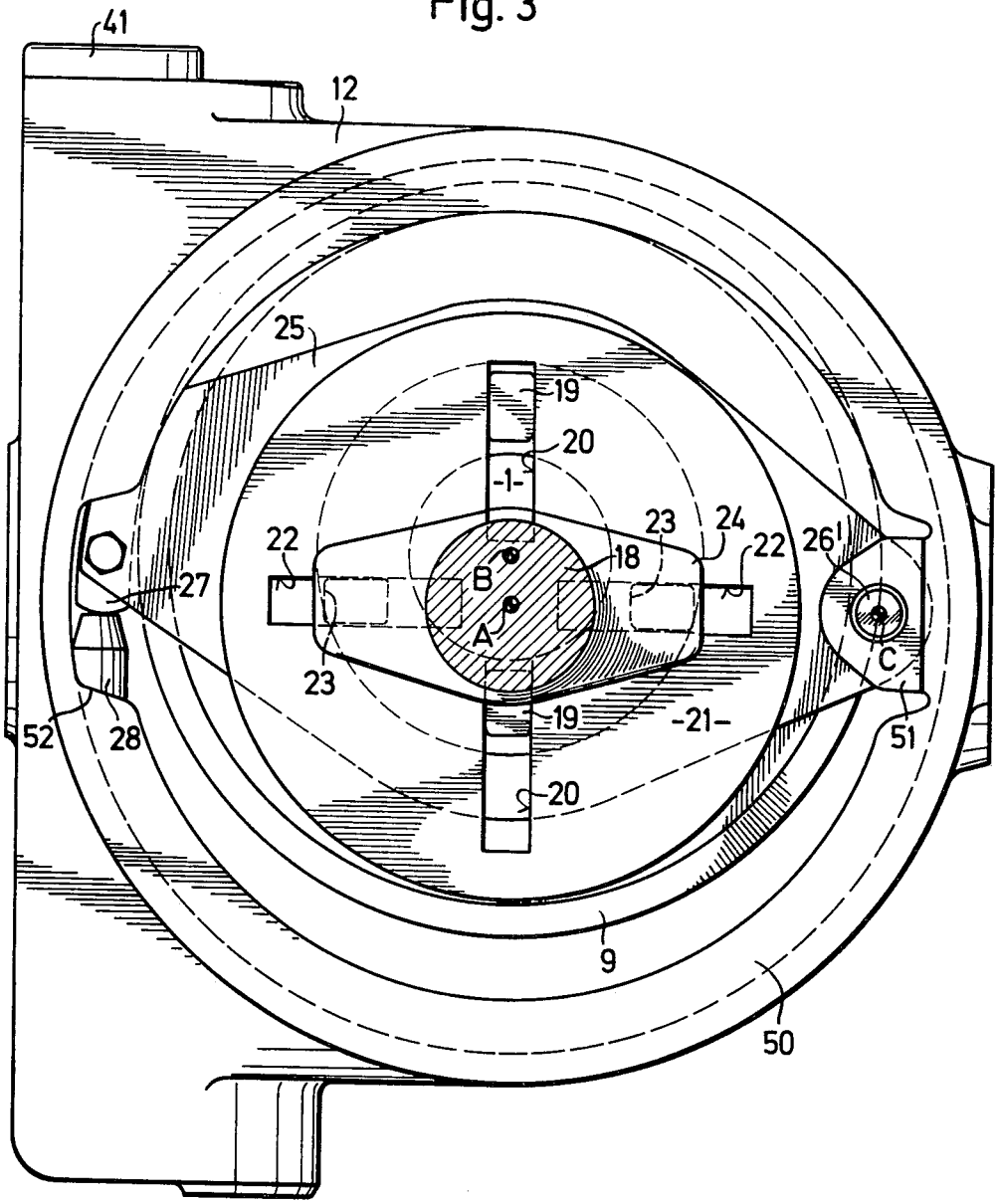
Figure 5:
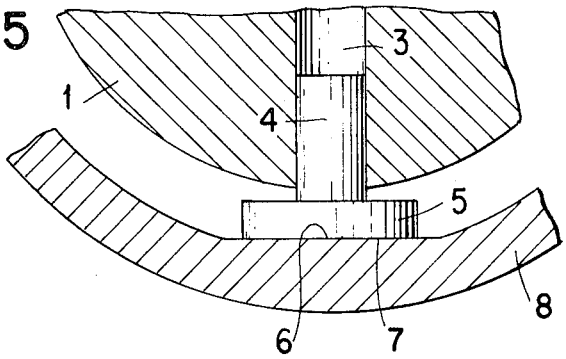
Figure 4:
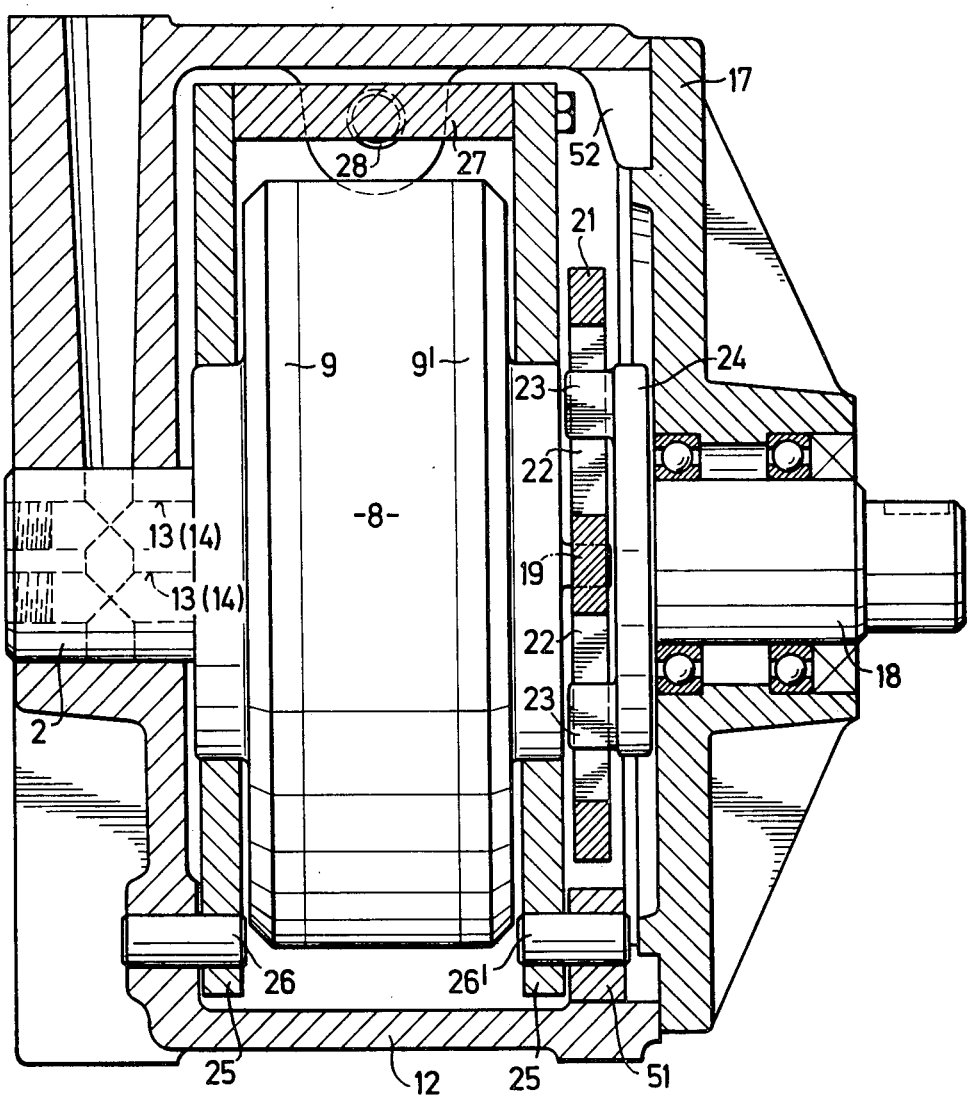

These and other objects and advantages of the invention will become more apparent from the following detailed description and appended claims taken in conjunction with the accompanying drawings in which:

FIG. 1 illustrates an axial section through a piston machine according to the invention on the line I;13 I in FIG. 2;

FIGS. 2 and 3 each illustrate a vertical section through the machine on the line II—II and III—III respectively in FIG. 1; and FIG. 4 illustrates a horizontal section through the machine on the line IV—IV in FIG. 1, and FIG. 5 illustrates a fragmentary view of the guide member of the machine of FIG. 1.

Referring to FIG. 1, the hydrostatic piston machine comprises a housing 12 of generally cup-shaped configuration in which a smooth cylindrical pintle 2 is fixedly secured at one end about a longitudinal axis A. In addition, a cylinder block 1 is rotatably mounted about the pintle 2 about the axis A. This cylinder block 2 has radial cylinder bores 3 in which pistons 4 are movably mounted and peripherally disposed about the block. Each piston 4 has a foot 5 at the outer end on which a plane support surface 6 is formed. A guide member is mounted about the cylinder block 1 on a second longitudinal axis B. This guide member includes a guide ring 8 having plane guide surfaces 7 (as shown in FIG. 5) on which the support surfaces 6 of the pistons 4 are guided. The guide surfaces 7 are disposed in known manner tangantially to a circular cylindrical surface of axis B which is normally eccentric of the axis A of the pintle 2. FIGS. 1 and 2 shows the maximum eccentricity The annular guide member also comprises two disc-shaped side walls 9,9' having two centrally disposed outwardly extending hub-shaped projections 10, 11 on their inner periphery. These projections 10, 11 bound bores which are coaxial of the axis B. The diameter of the bore in projection 10 is substantially equal to the pintle diameter plus twice the maximum eccentricity. As shown, the side walls 9, 9' are secured to the guide ring 8 by bolts.

The pintle 2 has ducts 13, 14 respectively for the supply and discharge of a hydraulic pressure medium. These ducts 13, 14 communicate with control ports 15, 16 which are provided in the pintle 2 and over which the cylinder bores 3 move on rotation of the cylinder block 1. The right-hand side of the housing 12 in FIG. 1 is provided with a cover 17 in which a shaft stub 18 is rotatably mounted either to supply or take-off the torque depending upon the machine operation (pump or motor, respectively). For this purpose, a suitable means is provided on the guide member for suppyling and/or taking off the torque. For example, for torque transmission, the side wall 9′ of the annular guide member has two diametrically opposite dogs 19 projecting into two radial slots 20 in a clutch disc 21. The disc 21 also has two slots 22 offset by 90° in relation to the slots 20 which receive two projecting dogs 23 of a driver 24 secured to the shaft stub 18 (FIG. 3).

The annular guide member 8, 9, 9′ is mounted by way of the hub-shaped projections 10, 11 in a movable guide means which is located within the housing 12 and which serves to move the guide member in order to vary the eccentricity between the axis B of the guide member and pintle axis A. To this end, the movable guide means includes a pair of one-armed levers 25 (FIG. 2) each of which mounts a projection 10, 11 of the guide member therein. The guide member is thus mounted at oposite sides in the guide means.

The levers 25 are both pivotally mounted at one end on a common pivot axis C via a respective pivot 26, 26′ fixed in the housing 12 (FIG. 4). This pivot axis C is located within or on the circumference of the guide member 8, 9, 9′.

As will be apparent from FIG. 1, the housing 12 has an inwardly projecting flange 50 on the open side facing the cover 17, whereby the cover 17 can be connected to the housing 12 via bolts (not shown). As seen in FIG. 3, the flange 50 is interrupted in the region of the pivot axis C so that a bearing boss 51 receiving the pivot 26′ can be accommodated in the housing 12. The securement of the boss 51 is not shown in detail but can be effected, for example by means of bolts extending thrugh the housing 12 from outside. The flange 50 is also provided with a recess 52 diametrically opposite the pivot axis C, the size of the recess 52 being such that the levers 25 can be introduced by their free ends axially into the housing 12 prior to mounting of the cover 17.

The guide means also includes means for mounting the free ends of the levers 25 in elastically resilient manner within the housing 12 as well as a control piston 35 within the housing 12 for adjusting the levers 25 relative to the housing 12.

As shown in FIG. 2, the free ends of the levers 25 are connected via a cross-member 27 which bears on one side on a pin 28 which is displaceably mounted in a bore 29 in the housing 12. This bore 29 also accommodates a compression spring 30 which biases the pin 28 upwards as viewed in FIG. 2.

The control piston 35 is disposed opposite the pin 28 and bears against the opposite side of the cross-member 27 while being disposed in a bore 36 of the housing 12. This control piston 35 includes an axial bore 37 which communicates with the interior of the housing 12 via two bores 38 as well as an enlarged internal annular recess 42 intermediately of the bore 37 and at least one duct 43 which communicates the recess 42 with one end of the control pistion 35, i.e. the closed end within the housing bore 36 at which a chamber 44 is formed. The lower end of the recess 42, as viewed, forms a control edge 32.

The guide means further employs a small cylindrical piston 39 which is slidably mounted within the bore 37 of the control piston 35. This cylindrical piston 39 has a free end face wich is concentrically within the annular recess 42 to cooperate with the control edge 32. The cylindrical piston 39 is secured to a tension spring 40 so as to be suspended in the control piston 35. This spring 40 is, in turn, secured to a cover 41 which is located over the bore 36 and chamber 44 and which forms a part of the housing 12.

The chamber 44 which is of cylindrical shape is connected via a duct 45 and line 46 to a pressure medium supply of the machine. In this way, the control piston 35 can be made subject to the pressure of a flow of pressure medium in the machine. At the same time, the tension spring 40 biases the small piston 39 against the pressure of the pressure medium acting on both the control piston 35 and the piston 39. An adjustable pressure reducing means, such as a valve 47, is also connected in line with the control piston 35 in order to reduce the pressure of a flow of pressure medium delivered to the chamber 44.

The pressure in the cylinder chamber 44 can be controlled by means of the pressure reducing valve 47 so that the position of the small piston 39 can be adjusted in relation to the cooperating control edge 32 of the recess 42. This also adjusts the position of the control piston 35 and hence the position of the pair of pivoting levers 25. By means of the control piston 35, the pair of pivoting levers 25 can be moved from the position illustrated in FIG. 1, having the eccentricity $+ e_{max}$, through zero, to the equal eccentricity $-e_{max}$.

When the levers 25 are in the position as shown in FIG. 2 for a maximum eccentricity, the pressure in the chamber 44 is zero and the spring 30 biases a lever 25 via the pin 28 upwardly, as viewed. If the eccentricity is to be changed, the chamber 44 is pressurized by the pressure medium via the duct 45. At this time, the piston 39 moves downward with the amount of downward movement being determined by the elongation of the spring 40. This elongation is proportional to the pressure of the pressure medium (the pressure is adjusted by means of the valve 47). The piston 35 follows the movement of the piston 39 and thereby pivots the lever 25 downward. The guiding ring 8, thus, also moves downward and the eccentricity of the axis B to axis A of the pintle 2 is decreased.

The position of the piston 35 is always determined by the interaction of the control edge 32 with the lower edge of the piston 39. However, during a stationary operation, the piston 35 oscillates slightly up and down. As a result, the pressure of the pressure medium in the recess 42 periodically rises and falls. If the pressure increases somewhat, the control edge 32 with the piston 35 moves slightly downward until passing the lower edge of the piston 39. A small amount of pressure medium then passes from the recess 42 and the pressure decreases. The pressure medium passing from the recess 42 passes through the bores 38 into the interior of the housing 12. After displacement of the pressure medium from the recess 42, the piston 35 rises somewhat under the influence of the spring 30. As a result, the control edge 32 is again positioned above the lower edge of the piston 39 and the pressure of the pressure medium again increases slightly in the recess 42. This small oscillating movement of the piston 35 has no effect on the operation of the machine.

If the eccentricity is to be further decreased or is to be moved into the negative zone, the pressure of the pressure medium introduced via the line 46 is increased by means of the valve 47. Thus, the piston 39 takes up a new position lower than the earlier described position. The piston 35 follows the new position of the piston 39 and the control edge 32 oscillates in the area of the lower edge of the piston 39 as described above.

As shown in FIG. 2, the bore 29 for the pin 28 does not have any pressure medium therein. Rather, the bore 29 is connected via a bore 48 with a pressure medium outlet 49 of the housing. This latter outlet 49 serves to allow any pressure medium exiting from the bores 38 into the housing 12 to discharge.

In the exemplified embodiment described, a pair of one-armed pivoting levers is used in the guide means to allow the eccentricity to be changed. Alternatively, the guide means can be constructed to use a movable parallel guide which is disposed in the housing and which accomodates the guide member 8, 9, 9' on both sides.

What is claimed is:

1. A hydrostatic piston machine comprising a housing;

a pintle fixedly secured within said housing about a longitudinal axis;

a cylinder block rotatably mounted on said pintle within said housing and about said longitudinal axis;

a plurality of pistons movably mounted in said cylinder block and peripherally disposed about said cylinder block, each said piston having a support surface at an outer end;

a guide member mounted about said cylinder block about a second longtudinal axis, said guide member having a plurality of plane guide surfaces disposed tangentially to a circuilar cylindrical surface normally eccentric to said axis of said cylinder block, each said guide surface having a support of a respective one of said pistons guided thereon;

a movable guide means within said housing mounting said guide member therein for varying the eccentricity of said guide member axis to said pintle axis; and means on said guide member for supplying and/or taking-off the torque of the machine.

2. A hydrostatic piston machine as set forth in claim 1 wherein said guide means mounts said guide member therein at opposite sides of said guide member.

3. A hydrostatic piston machine as set forth in claim 1 wherein said guide member includes a pair of centrally disposed outwardly extending hub-like projections at opposite sides thereof and said guide means includes a pair of one-armed levers, each said lever having a respective one of said projections mounted therein.

4. A hydrostatic piston machine as set forth in claim 3 wherein said levers are pivotally mounted at one respective end on a common pivot axis disposed within or on the circumference of said guide member.

5. A hydrostatic piston machine as set forth in claim 3 wherein said guide means further includes means for mounting the free ends of said levers in elastically resilient manner within said housing and a control piston within said housing for adjusting said levers relative to said housing, said control piston being subject to the pressure of a flow of pressure medium in the machine.

6. A hydrostatic piston machine as set forth in claim 5 which further comprises an asjustable pressure reducing means connected with said control piston to reduce the pressure of a flow of pressure medium thereto.

7. A hydrostatic piston machine as set forth in claim 5 wherein said conrol piston includes an axial bore, an enlarged internal annular recess intermediately of said bore, and at least one duct communicating said recess with one end of said control piston, and which further comprises a smooth cylindrical piston slidably mounted within said bore, said cylindrical piston having a free end face concentrically within said annular recess to define a control edge and a spring secured to said cylindrical piston and said housing to bias said cylindrical piston against the pressure of the pressure medium acting on said control piston and said cylindrical piston.

* * * * *